US006602129B1

(12) United States Patent
Sokolean et al.

(10) Patent No.: US 6,602,129 B1
(45) Date of Patent: Aug. 5, 2003

(54) AIR COOLING ELEMENT, METHOD FOR OPERATING THE SAME, AND AN AIR COOLING ARRANGEMENT

(75) Inventors: Helmuth Sokolean, Uerikon (CH); Klaus Roschmann, Uznach (CH); Josef Ender, Bichelsee (CH); Beat Schönbächler, Gross (CH)

(73) Assignee: Barcol-Air, AG, Stafa (CH)

( * ) Notice: Subject to any disclaimer, the term of this patent is extended or adjusted under 35 U.S.C. 154(b) by 0 days.

(21) Appl. No.: 09/674,552

(22) PCT Filed: Feb. 25, 2000

(86) PCT No.: PCT/CH00/00104

§ 371 (c)(1),
(2), (4) Date: May 16, 2001

(87) PCT Pub. No.: WO00/52395

PCT Pub. Date: Sep. 8, 2000

(30) Foreign Application Priority Data

Mar. 3, 1999 (CH) ..... 388/99

(51) Int. Cl.[7] ..... F24F 7/00
(52) U.S. Cl. ..... 454/296; 454/187
(58) Field of Search ..... 454/296, 292, 454/187, 270, 338

(56) References Cited

U.S. PATENT DOCUMENTS

| | | | | | |
|---|---|---|---|---|---|
| 3,363,532 | A | * | 1/1968 | Horneff | 454/187 |
| 3,602,212 | A | * | 8/1971 | Howorth | 454/296 |
| 4,876,949 | A | * | 10/1989 | Fairchild et al. | 454/296 |
| 5,111,739 | A | * | 5/1992 | Hall | 454/296 |
| 5,281,187 | A | * | 1/1994 | Whitney, Jr. | 248/343 |
| 5,779,534 | A | * | 7/1998 | Kunec | 118/326 |
| 5,807,171 | A | * | 9/1998 | Felsen | 454/296 |
| 6,004,204 | A | * | 12/1999 | Luxton et al. | 345/733 |
| 6,113,486 | A | * | 9/2000 | Beudon et al. | 454/187 |
| 6,139,422 | A | * | 10/2000 | Blaschke | 454/166 |
| 6,267,666 | B1 | | 7/2001 | Wilhelmi | 454/292 |

FOREIGN PATENT DOCUMENTS

| | | |
|---|---|---|
| DE | 2457984 | 6/1976 |
| DE | 3605539 A1 | 8/1987 |
| DE | 4421167 A1 | 12/1995 |
| GB | 2033075 | 5/1980 |
| GB | 2155170 | 9/1985 |

* cited by examiner

*Primary Examiner*—Derek S. Boles
(74) *Attorney, Agent, or Firm*—Finnegan, Henderson, Farabow, Garrett & Dunner, L.L.P.

(57) ABSTRACT

In order to achieve a high cooling power while avoiding troublesome cold air flows, a chamber (2) is sealed, from the room to be cooled, by a thin cooling wall (1) of powder-coated steel with micro-holes which are arranged in a square 5 mm grid and have a diameter of 0.5 mm and whose free cross-section is consequently less than 1%. An antechamber (4) which is connected to the chamber (2) through a partition (3) by means of a distributor nozzle (17) and has air connections for connection to an air supply or an adjacent air-cooling element is arranged above the chamber (2). The cool air is introduced into the chamber (2) via the distributor nozzle (17) in such a way that it passes with high turbulence along the inside of the cooling wall (1). An air-cooling arrangement consists of rows, arranged side by side, of air-cooling elements whose antechambers (4) are connected by connecting nipples which each project into connecting orifices (10) of adjacent air-cooling elements.

47 Claims, 9 Drawing Sheets

AIR COOLING ELEMENT, METHOD FOR OPERATING THE SAME, AND AN AIR COOLING ARRANGEMENT

FIELD OF THE INVENTION

The invention relates to an air-cooling element, a process for its operation and an air-cooling arrangement. Such air-cooling elements are used for the air-conditioning of rooms.

PRIOR ART

GB-A-2 033 075 discloses an air-distributing element which is of the generic type in its basic design and serves for supplying air to an industrial workplace. The chamber is connected by a series of perforations in a partition to an antechamber provided with an air connection. The chamber has a porous wall through which the air flows out. However, this does not permit accurate control of the air flow. The known air-distributing element is therefore not suitable for ensuring that no troublesome cold air flows occur while at the same time having an adequate cooling effect.

DE-A-44 21 167 discloses a further air-distributing element for distributing cooled air too, comprising a chamber which is bounded on one side by two parallel fabric layers a slight distance apart. In this case too, accurate control of the air flow is not possible.

SUMMARY OF THE INVENTION

It is an object of the invention to provide an air-cooling element which ensures control, in particular limitation of the air flow into the room to be cooled. This exemplary object is achieved by an air-cooling element having a cooling wall that is made of a substantially impermeable material and includes a plurality of micro-holes distributed over its area so that its free cross-section is less than 2% of its area. In addition, it is intended to provide a suitable process for its operation and an air-cooling arrangement which is constructed in a simple manner from air-cooling elements according to the invention.

The advantages achieved by the invention are in particular that the air is supplied in a very controlled and uniform manner and troublesome compact cold air flows in the room to be cooled are avoided even at high cooling power. The air-cooling arrangement according to the invention may be constructed from a plurality of connected air-cooling elements in a very simple manner.

BRIEF DESCRIPTION OF THE DRAWINGS

Below, the invention is explained in more detail with reference to the Figures which illustrate the exemplary embodiments.

DESCRIPTION OF THE PREFERRED EMBODIMENTS

Figure 1A:
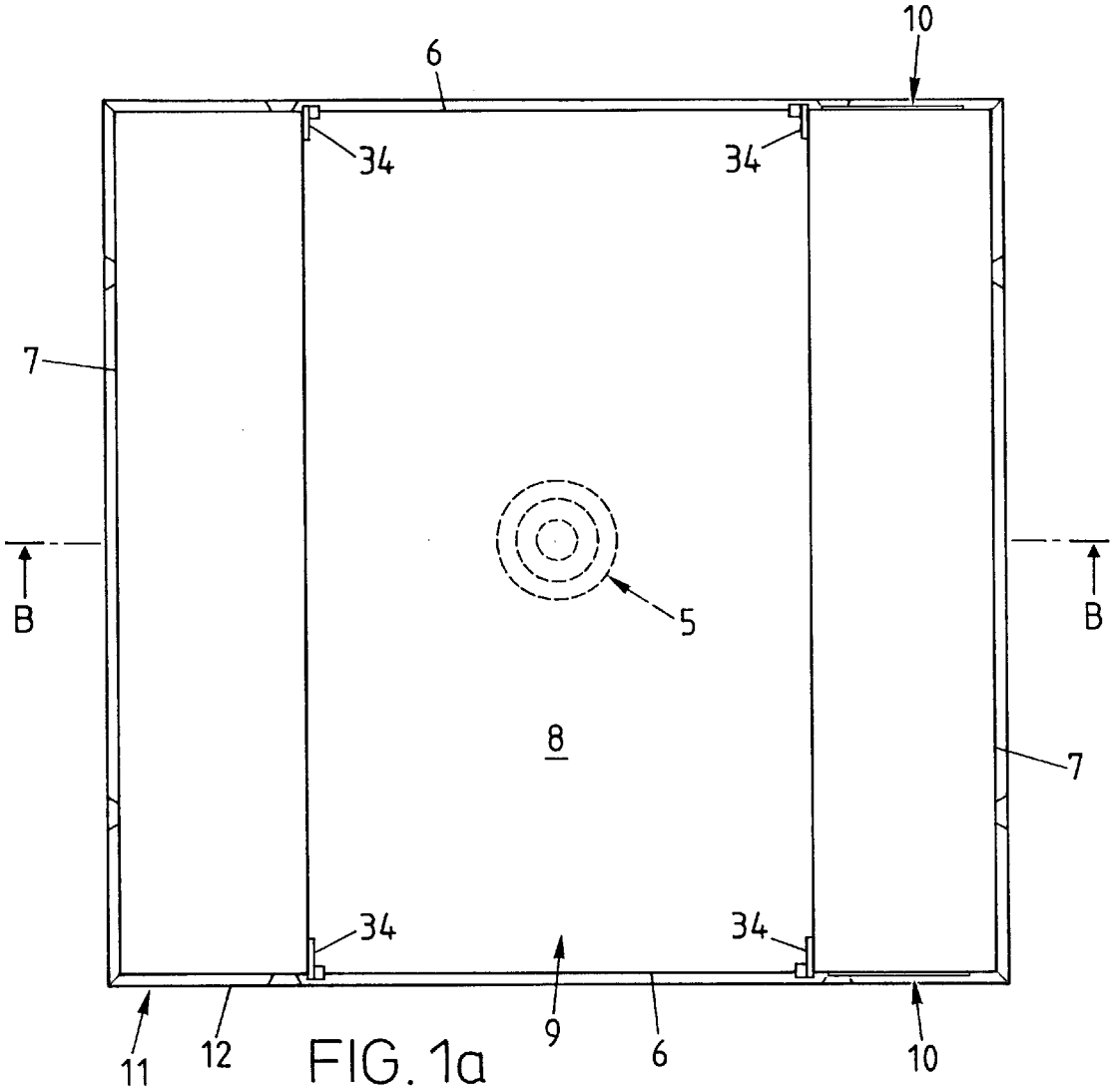
FIG. 1*a* shows a plan view of a first embodiment of an air-cooling element according to the invention.
Figure 1B:
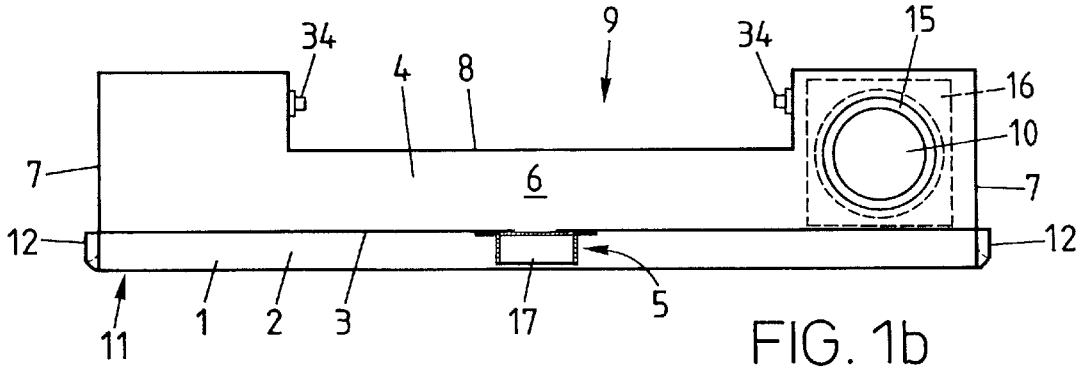
FIG. 1*b* shows a section along B—B in FIG. 1*a,*

Air-cooling elements according to the invention are as a rule mounted underneath the ceiling of a room to be cooled. As is evident in particular from FIGS. 1*a,b*, a first embodiment of such an air-cooling element has, on the underside facing the room, a rectangular, in particular square, cooling wall 1 which bounds the bottom of a chamber 2. At the top, the chamber 2 is bounded by a partition 3 which is parallel to the cooling wall 1 and separates said chamber from an antechamber 4 to which it is connected by means of an air inlet 5. Otherwise, the chamber 2 is closed air-tight by two front walls 6, two sidewalls 7 and the partition 3, so that the inflow of cool air is possible only through the air inlets 5 and outflow only through the cooling wall 1.

The cooling wall 1, too, consists of strong air-impermeable material. Its permeability is based only on micro-holes which are preferably uniformly distributed over the cooling wall 1. They may be arranged in a regular, e.g. square, grid at intervals of, for example, 5 mm. The diameter of a micro-hole may be, for example, 0.5 mm. It should as far as possible not be greater than 0.8 mm, preferably not greater than 0.6 mm. The proportion of the free cross-section, i.e. of the total area, of the micro-holes relative to the cooling wall 1 should as far as possible be not more than 2%, preferably not more than 1%.

The antechamber 4, which has the same horizontal dimension as the chamber 2, is closed at the top by a top wall 8 and laterally likewise by the front walls 6 and sidewalls 7. At the top, the air-cooling element has, in the centre, a broad recess 9 of rectangular cross-section, which is continuous and transverse to the front walls 6. Each of the front walls 6 has, between its lateral edge and the recess 9, a connecting orifice 10 which serves for establishing a connection between the antechamber 4 and that of an adjacent air-cooling element or an air supply. The two connecting orifices 10 are each arranged on different sides of the central recess 9, so that they are offset with respect to one another by a relatively large distance. Apart from these air connections and the connection to the chamber 2 by means of the air inlets 5, the antechamber 4, too, is closed essentially air-tight.

The front walls 6, the sidewalls 7, the partition 3 and the top wall 8 are preferably in the form of aluminium plates and are adhesively bonded to one another. The cooling wall 1 is preferably a Zinkor plate, i.e. a steel plate having a powder coating which serves for corrosion protection and has a high absorption coefficient for radiation in the infrared range. Its thickness is preferably not more than 1 mm, in particular 0.62 mm. It is part of a trough 11 which has a raised all-round sidewall 12 which surrounds the lower sections of the front walls 6 and the sidewalls 7 of the chamber 2 at a small distance. The sidewall 12 has, on each side, two slots 13 which emanate from the upper edge, are each arranged in an elongated indentation surrounding them and each receive a screwbolt 14 which is screwed into a hole in the respective front wall 6 or sidewall 7 in such a way that the heads of screwbolts 14 which project beyond the edges of the slots 13 clamp the sidewall 12 of the trough 11 to said walls of the chamber 2. To produce an air-tight connection, an all-round seal is clamped between the lower edges of the front walls 6 and of the sidewalls 7 on the one hand and of the trough 11 on the other hand. Because the trough 11 projects slightly laterally, it is possible to arrange air-cooling elements in such a way that they are adjacent to one another without any gaps.

Figure 4:
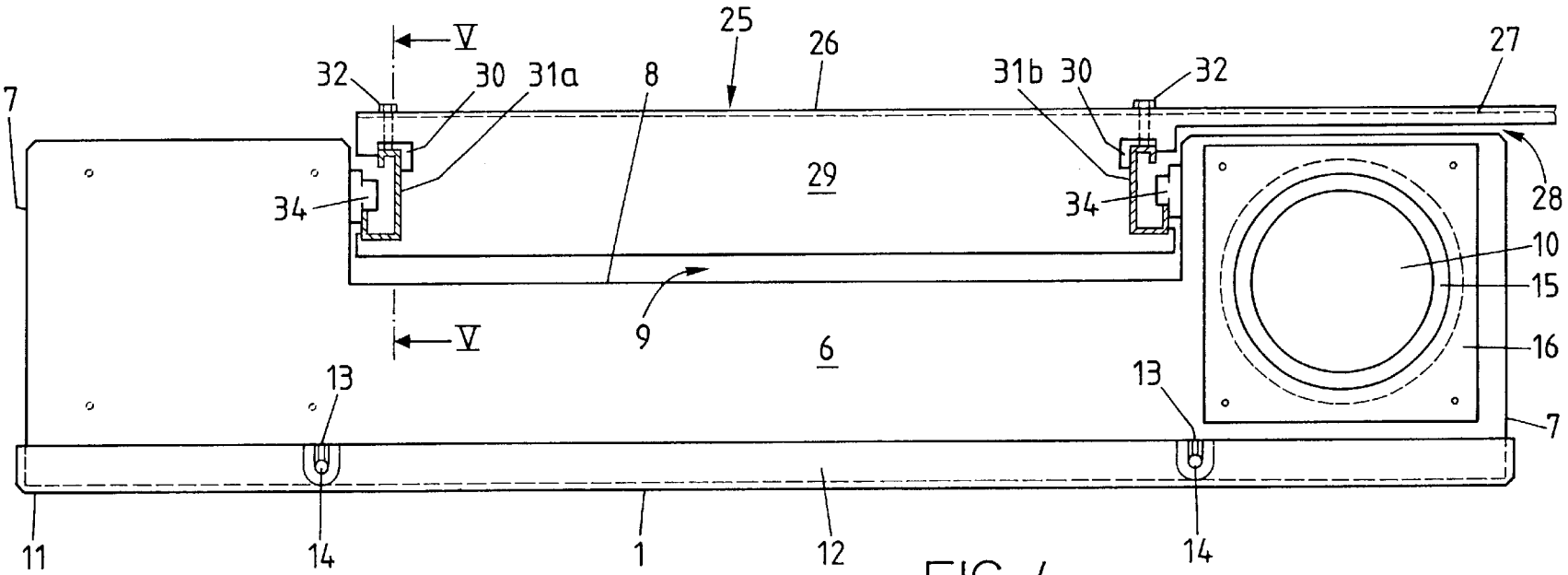
FIG. 4 shows a front view of the first embodiment of an air-cooling element according to the invention in the air-cooling arrangement according to FIG. 3.

The connecting orifices 10 (also see FIG. 4) in the front walls 6 are round. In the edge region of a connecting orifice 10, a sealing ring 15 whose inner edge projects freely above its edge and whose outer edge region is clamped between the front wall 6 and a retaining plate 16 connected thereto is mounted in each case. The sealing ring 15 consists of an extensive elastic material, preferably neoprene, and rests in an annular manner in the plane of the connecting orifice 10.

Figure 2A:
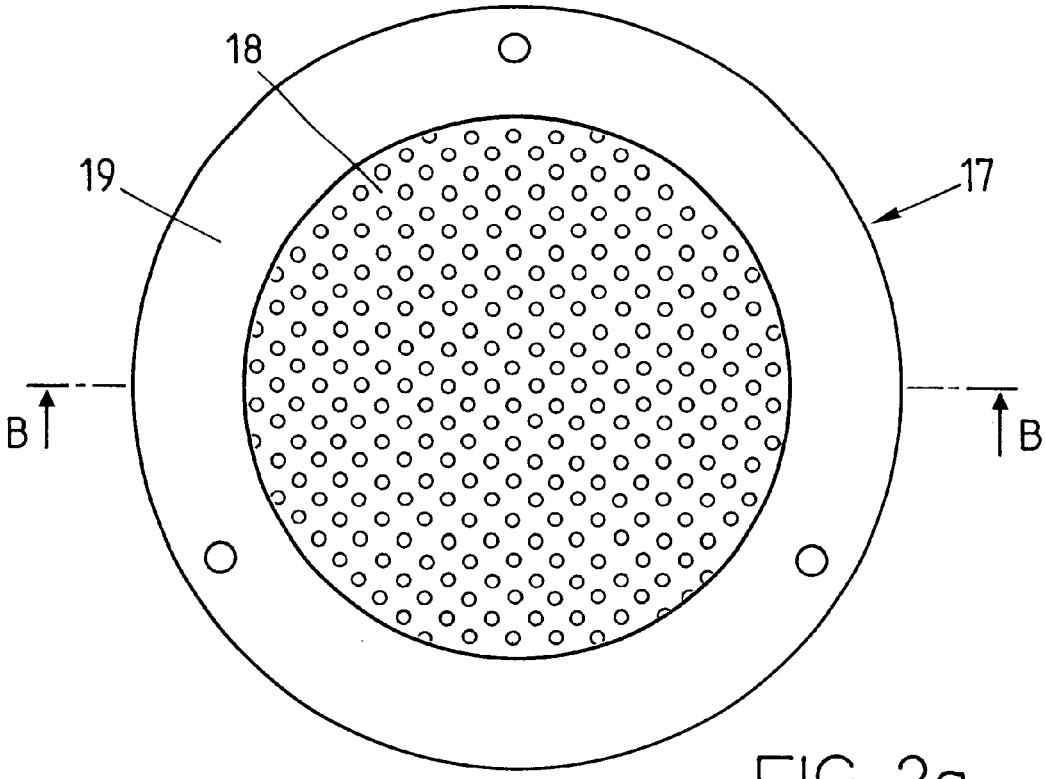
FIG. 2*a* shows a plan view of a distributor nozzle of the first embodiment of the air-cooling element according to the invention.
Figure 2B:
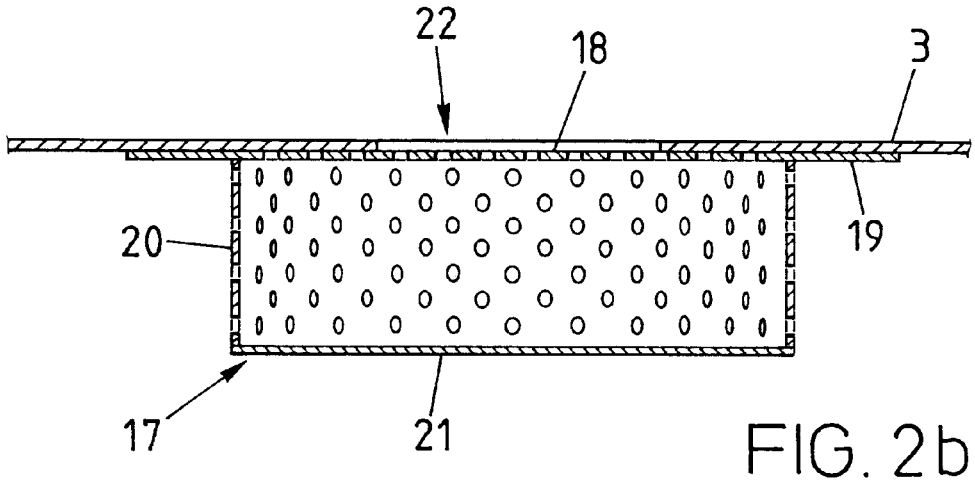
FIG. 2*b* shows a section through the distributor nozzle and a partition to which it is fastened, corresponding to B—B in FIG. 3*a,*

The air inlet 5, which connects the chamber 2 to the antechamber 4, comprises (FIG. 2*a,b*) a distributor nozzle 17 which is fastened to the underside of the partition 3 and projects into the chamber 2. It is cylindrical, with, at the top, a round perforated cover 18 which is surrounded by an annular fastening flange 19 and is abutted by a casing 20 which is likewise perforated. The distributor nozzle 17 is closed on the underside by a continuous base 21 having no orifices. It is a slight distance away, for example about 2 mm, from the cooling wall 1. The cover 18 and the casing 20 have, for example, round passages of 1 mm diameter and have a hole fraction of about 22%. The partition 3 has, above the distributor nozzle 17, a circular passage 22 whose diameter, for adjusting the air flow, can be chosen to be the same size as or, as shown, slightly smaller than that of the cover 18.

Figure 3:
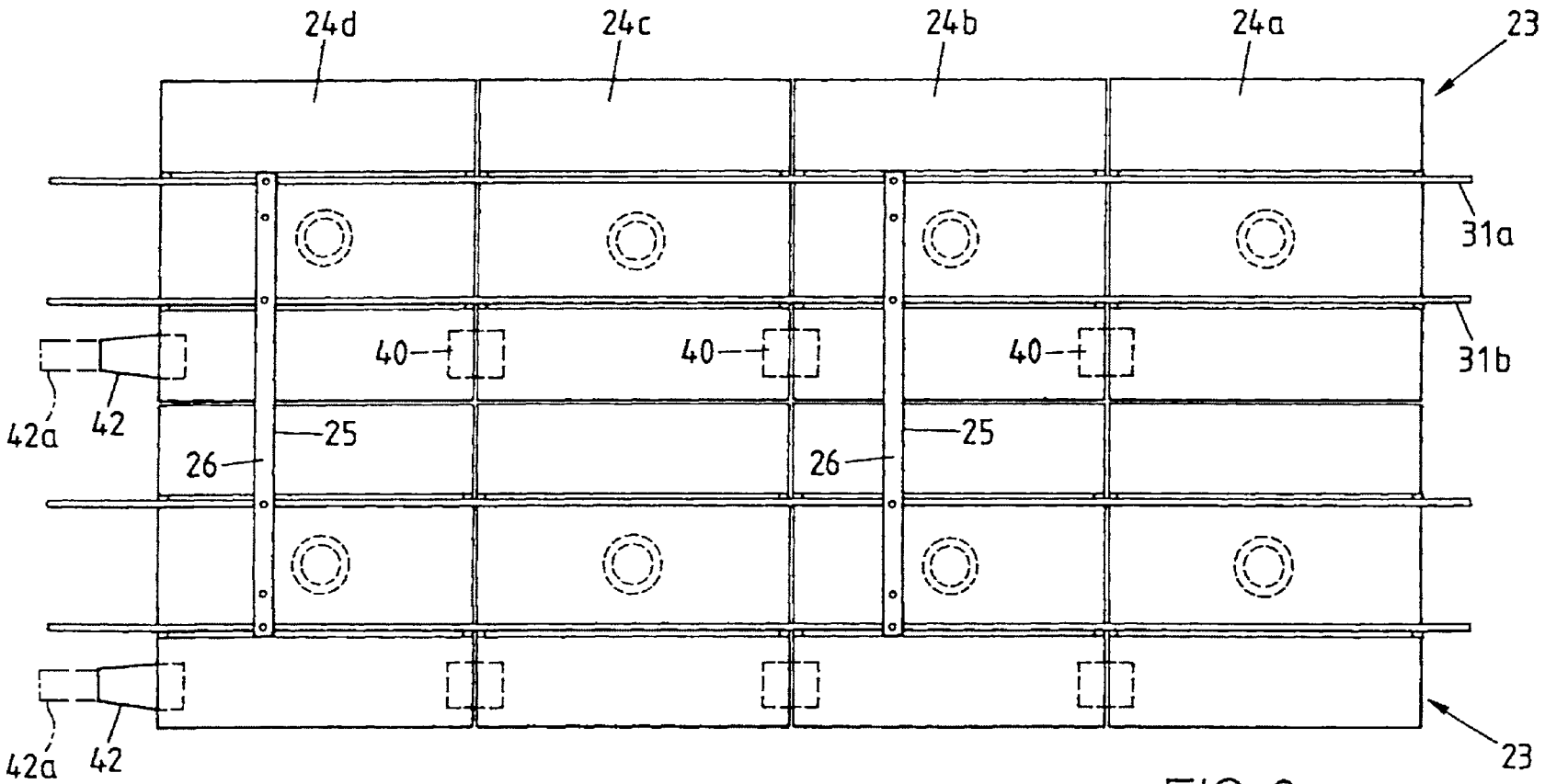
FIG. 3 shows a plan view of an air-cooling arrangement according to the invention, comprising air-cooling elements according to the first embodiment.

As a rule, an air-cooling arrangement 23, which in each case consists of a plurality of parallel rows of air-cooling elements 24*a,b,c,d* of the type described is suspended from a fastening means on the ceiling of the room to be cooled (FIG. 3), in such a way that the cooling walls 1 are adjacent to one another without gaps or with a defined joint. For this purpose, parallel brackets 25 (also see FIG. 4) are fastened to the ceiling at intervals which each correspond, for example, to twice the length of an air-cooling element, which brackets have in each case a horizontal flange 26 and a vertical strip 27 which projects downwards from said flange and forms a plurality—two in the case shown—of broad lugs 29 which are separated by intermediates spaces 28 and have approximately C-shaped lateral recesses 30 in the lateral edges.

In each case rails 31*a,b* having a C-shaped cross-section are placed through recesses 30 of successive brackets 25, which recesses are in a line. Said rails are fixed and positioned at the underside and laterally in the recesses 30 by stops formed by the edges of the recesses 30. To enable the rails 31*a,b* to be introduced in a slightly twisted state into the recesses 30, the latter are designed so that the rails 31*a,b* have slight vertical play. They are then each fixed by means of a screwbolt 32 which is screwed into a threaded hole in the flange 36 and is lowered until its lower end presses against the top of the rail 31*a,b*.

Figure 5A:
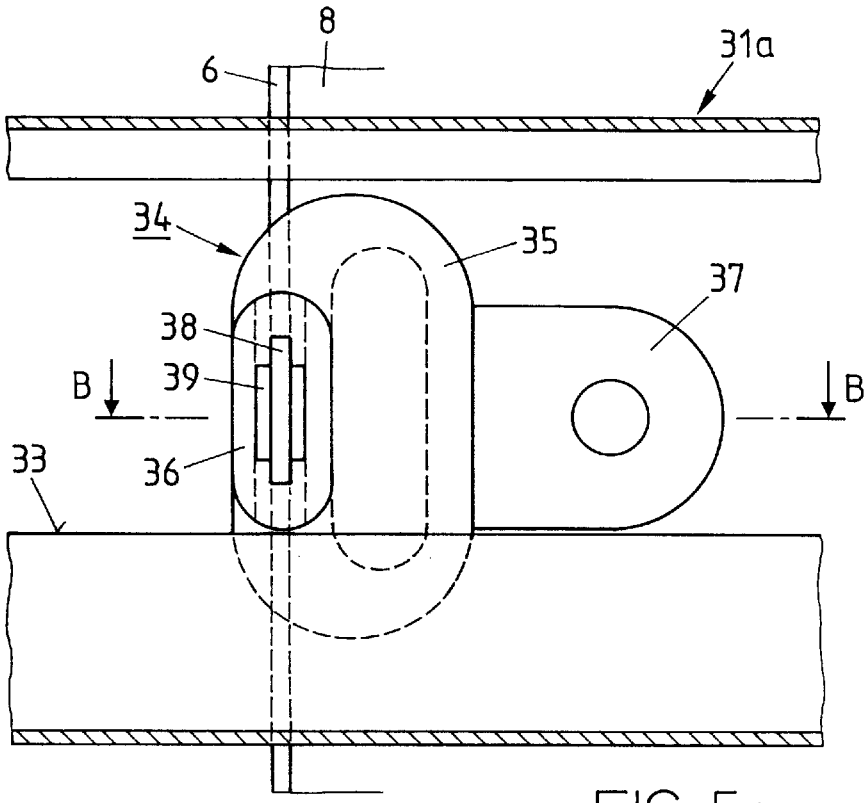
FIG. 5*a* shows an enlarged detail of the air-cooling arrangement according to the invention, corresponding to a section along V—V in FIG. 4.
Figure 5B:
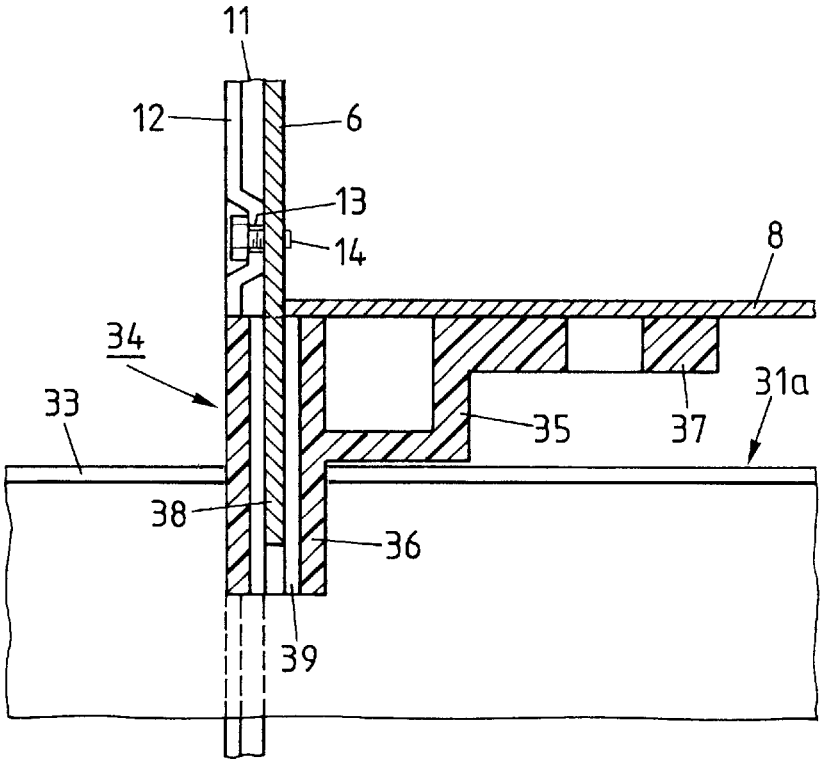
FIG. 5*b* shows a section along B—B in FIG. 5*a,*

The outer limb of a rail 31*a,b* forms (FIGS. 5*a,b*) a continuous upward-pointing support strip 33 which passes through the recess 30 slightly above the lower edge. Each air-cooling element is provided at the two ends of the recess 9 with two pairs of retaining cams 34 which are opposite one another and which are fastened above the bottom of the recess 9 to the sidewalls thereof and project horizontally into such recess. Each retaining cam 34 is in the form of, for example, a plastics part produced by the injection moulding process and has a base 35 with a projecting support peg 36 and a lug 37 which adjoins the base 35 and rests against the sidewall of the recess. Each retaining cam 34 is pushed onto an extension 38 of the front wall 6, which extension projects from the side into the recess 9 and is held without play by a channel 39 passing through the base 35 and the support peg 36. It is thus reliably fastened in a simple manner. The support peg 36 rests on the support strip 33 while the base 35 forms a lateral sliding surface which points towards the outside of the outer limb of the respective rail 31*a;b* and acts as a stop. The air-cooling element thus has, at both ends, only slight lateral play relative to the rail arrangement but is displaceable in the longitudinal direction along the rails 31*a,b*.

For producing an air-cooling arrangement, the brackets 25 are therefore first suspended under the ceiling a distance apart, for example by means of downward-pointing bolts anchored in said ceiling. The rails 31*a,b* are then inserted into the recesses 30 and fixed by means of the screw bolts 32. A stop, for example in the form of a clamp, is mounted at one end of the rails 31*a,b*. Finally, the air cooling elements 24*a, b, c, d* of a row are pushed on in succession from the other end and finally fixed by a further stop mounted behind the last of said elements. The air-cooling elements are preferably of identical design. Only in the case of the first air-cooling element 24*a*, before it is pushed on, is the connecting orifice in the front wall terminating the row closed by a closure plate which corresponds to the retaining plate 16 but has no orifice. The air-cooling element 24*d* pushed on last is finally connected to an air supply line 42*a* by means of a slightly longer connecting piece 42.

Figure 6:
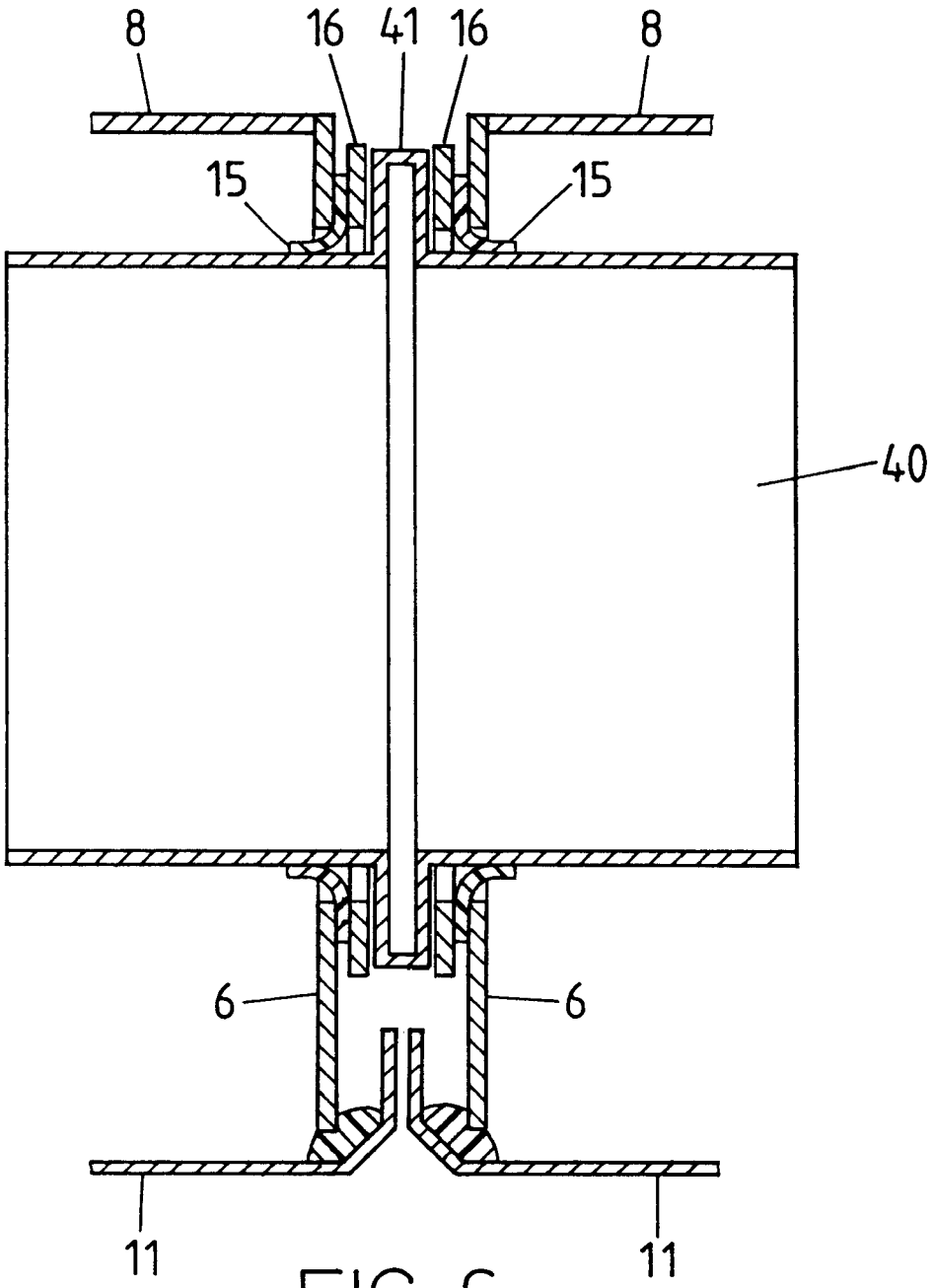
FIG. 6 shows a section through a connection between two successive air-cooling elements in an air-cooling arrangement according to the invention and according to FIG. 4.

The connection is produced in each case by pushing an end piece of a connecting nipple 40 (also see FIG. 6) into the connecting orifice 10 of the air-cooling element pushed on last. The external diameter of the connecting nipple 40 is in each case slightly smaller than the diameter of the connecting orifice 10 receiving it but is larger than the internal diameter of the sealing ring 15, which consequently undergoes an elastic expansion to rest in the manner of a collar against the outside of the connecting nipple 40 in such a way that the connection is essentially air-tight. This is supported in operation by the fact that the pressure in the antechamber 4 of the air-cooling element is slightly above the external pressure.

When the next air-cooling element is pushed on, the other end piece of the connecting nipple 40 is displaced into its connecting orifice 10 so that an identical tight connection forms. To ensure that the connecting nipple 40 is automatically correctly positioned, it has in the middle an all-round bead 41 which forms stop surfaces effective with respect to the retaining plates 16 of the two air-cooling elements and finally lies with slight play between them. It is of course also possible to connect the connecting nipple 40 to one of the two air-cooling elements firmly or, for example by a bayonet-type means, detachably. The connecting nipple 40 is preferably produced from aluminium or steel sheet. The bead 41 can be produced by compression. Instead of the bead, it is also possible to provide a ring which is welded on or attached by adhesive bonding.

During operation, cool air originating from a cooling unit and under slightly superatmospheric pressure flows through the air supply line, which is not shown, into the antechamber 4 of the air-cooling element 24*d* and is distributed through the connections described over the antechambers 4 of the further air-cooling elements 24*c,b,a*. In each of the air-cooling elements 24*a,b,c,d* cool air now flows from the antechamber 4 through the air inlet 5 into the chamber 2. Owing to the relatively large cross-section of the connections between the antechambers 4 of the air-cooling elements 24*a,b,c,d* and the considerably smaller cross-section of the passages of the air inlet 5 between the antechamber 4 and the chamber 2 in each thereof, a slight pressure drop, typically about 60 Pa, occurs in each case between the antechamber 4 and the chamber 2 of each air-cooling element, while essentially the same pressure prevails in the antechambers 4 of the various air-cooling elements 24*a,b,c,d*.

The air flow passing through the air inlet 5 into the chamber 2 is distributed by the distributor nozzles 17 in such a way that flows oriented directly against the cooling wall 1 are avoided. A pressure which is only a few Pa, typically about 10 Pa, above the external pressure and which results in a cool air flow which is very uniformly distributed over the area of the cooling wall 1 and passes through the micro-holes into the room underneath is built up in the chamber 2. By inserting two barriers, each having a relatively high flow resistance, between the air supply and the room to be cooled—in each case between the antechamber 4 and the chamber 2, between which in the case described 6/7 and as a rule at least ¾ of the total pressure drop occurs, and the chamber 2 and the room—any penetration of the flows which are inevitably associated with the cool air supply into the room is reliably avoided. Owing to the different position with respect to the air supply, irregularities in the cooling also cannot occur.

Owing to the small free cross-section of the cooling wall 1, the air remains on average for a relatively long time in the chamber 2, so that heat exchange with the room to be cooled takes place before its exit. In particular because the air is blown into the chamber 2 a relatively small distance away from the cooling wall 1 and essentially parallel thereto, a flow passing along the inner surface of the cooling wall 1 is produced and, since the air has already flowed through the perforated cover 18 and the perforated sidewall 20 of the distributor nozzle 17 and was subjected to strong vorticity, is also highly turbulent.

Even in the case of the nominal air flow rate of 45 m/h fed in during normal operation, this leads to a high heat transfer coefficient at the boundary of in general about 100 $W/m^2K$, usually over 80 $W/m^2K$, but in any case over 50 $W/m^2K$, at this surface, especially since the heat transfer is also supported by radiant exchange between the inside of the cooling wall 1 and the partition 3. Since, owing to its small thickness of 0.62 mm and the high thermal conductivity of about 50 W/mK, the cooling wall 1 has a very high heat transfer coefficient of about 100,000 $W/m^2K$, the total heat transfer coefficient between the air in the chamber 2 and the room air layer adjacent to the cooling wall 1 is limited virtually only by the heat transfer coefficient at the outer surface, which cannot be influenced to any extent, and is therefore relatively high.

Consequently, heat is exchanged in a very highly efficient manner between the air in the chamber 2 and the room air, through the cooling wall 1, which on the one hand contributes to the cooling of said room air in a manner which does not cause any troublesome flows, but on the other hand preheats the former so that its exit temperature is noticeably higher than the temperature which it has on entering the chamber 2, which reduces the danger of troublesome cold air flows. The cooling wall 1, which is kept at a relatively low temperature by the cool air, also supports the cooling air effect by radiant exchange with the room to be cooled. Owing to the small fraction of free cross-section, its efficiency in this respect is virtually not reduced.

The cooling effect is thus based on three mechanisms, namely the introduction of colder air into the room to be cooled through the micro-holes in the cooling wall 1, convection at said wall and heat conduction through it, and radiant exchange between its surface facing the room and objects therein.

Of course, numerous modifications of the embodiment described, both of the individual air-cooling element and of the air-cooling arrangement, are possible. Thus, the air-cooling element may be made, for example, in elongated form and may have two or more distributor nozzles. Larger distances may be provided between successive air-cooling elements of an air-cooling arrangement, for accommodating an exit air orifice or a lamp, which distances are bridged by relatively long connecting pipes shaped at the ends like the connecting nozzles 40.

Figure 7A:
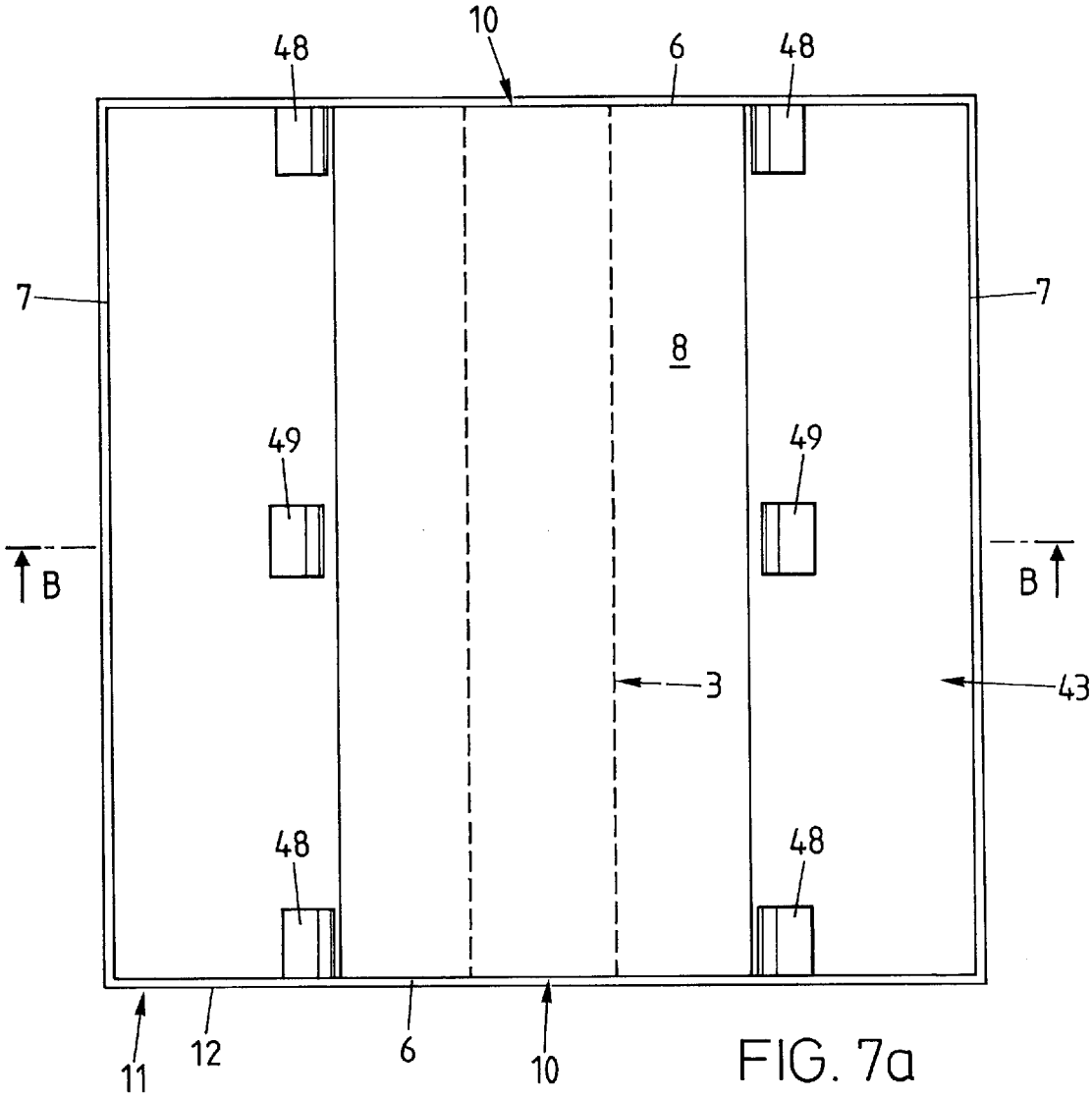
FIG. 7*a* shows a plan view of a second embodiment of an air-cooling element according to the invention.
Figure 7B:
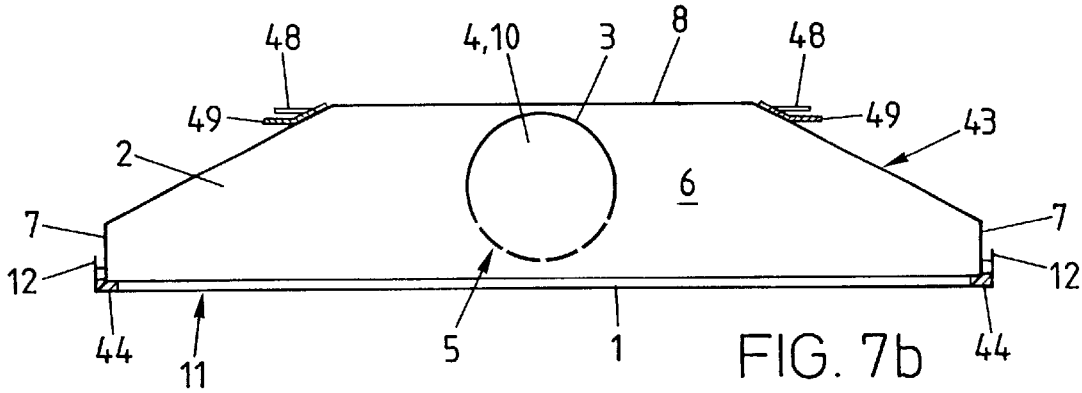
FIG. 7*b* shows a section along B—B in FIG. 7*a,*

In a second embodiment of an air-cooling element according to the invention, which is essentially identical in its basic design and its mode of operation but is formed somewhat differently in detail and which is distinguished by low production costs is shown schematically in FIG. 7*a,b*. The chamber 2 is likewise bounded at the bottom by a cooling wall 1 which is formed as described in connection with the first embodiment. In particular, it is part of a trough 11 having a raised all-round sidewall 12. At the top and laterally, it is bounded by a housing 43 comprising a top wall 8, which has a flat middle section which is adjoined on both sides by sections which slope obliquely downwards and which are adjoined by perpendicular sidewalls 7, and comprising front walls 6 which are provided with connecting orifices 10. An all-round sealing strip 44 of microcellular rubber is clamped between the lower edges of the front walls 6 and of the sidewalls 7 on the one hand and the edge of the cooling wall 1 on the other hand.

Figure 8A:
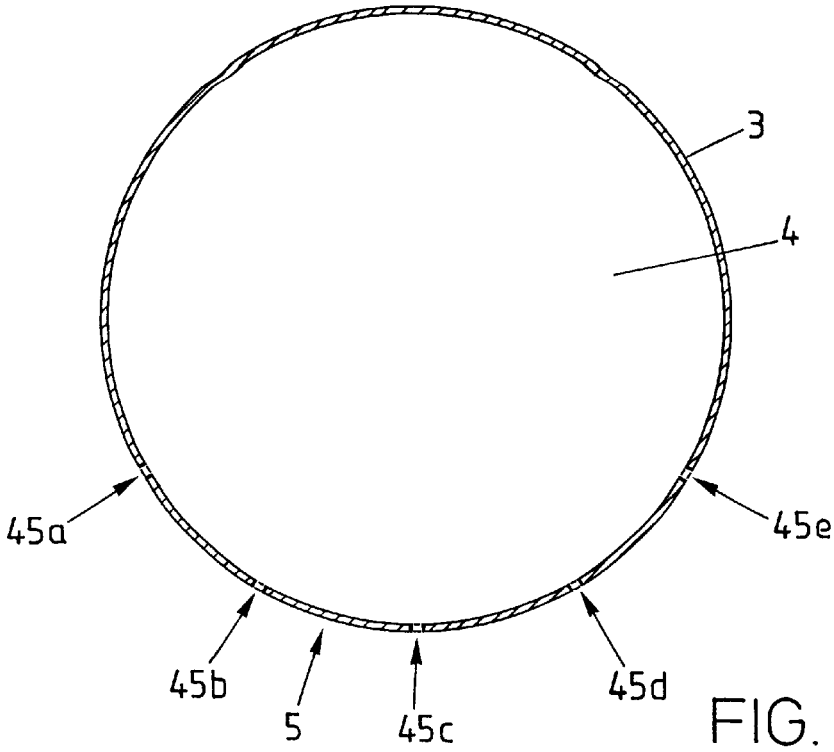
FIG. 8*a* shows a section through a partition of the second embodiment of the air-cooling element according to the invention.
Figure 8B:
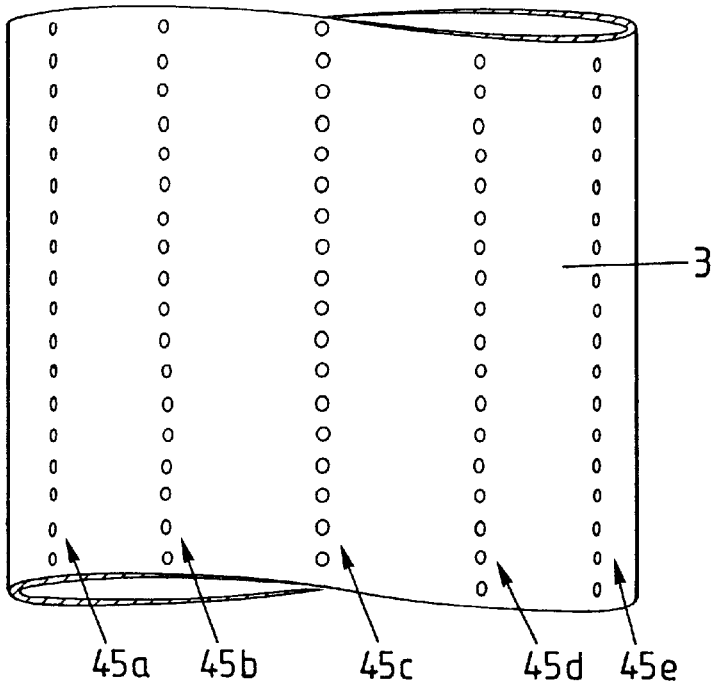
FIG. 8*b* shows a bottom view of the partition according to FIG. 8*a,*

The partition 3, which separates the antechamber 4 from the chamber 2 (FIG. 8*a,b*), is in the form of a tubular section which has a round cross-section and adjoins, on both sides, the connecting orifices 10 in the front walls 6. The air inlet 5 of the chamber 2 is formed by a multiplicity of passages which are provided directly in the partition 3, namely punched from the inside, and are arranged in the lower region of said partition, directed towards the cooling wall 1, in five rows 45*a,b,c,d,e*, which assume angular positions of 0°, ±30° and ±60° to the perpendicular. In the individual rows, the passages follow one another at intervals of, for example, 4.5 mm. Their diameter is in each case, for example, 1.2 mm. Especially since the passages are a distance away from the cooling wall 1—in the example, the distance of the lowermost row 45*c* is about 3.4 cm—the air passing through is subjected to sufficient turbulence in the chamber 2 so that there are no continuous air flows which are directed against the cooling wall 1 and might also be detectable underneath said cooling wall.

Depending on requirements and boundary conditions, it may also be most advantageous to provide the passages in another way. Thus, for example, the lowermost row 45*c* may be absent or the passages may be concentrated at the top of the partition 3. It is also possible to mount distributor nozzles, as described in the case of the air-cooling element according to the first embodiment, or corresponding profiles on the underside of the partition 3.

Figure 9:
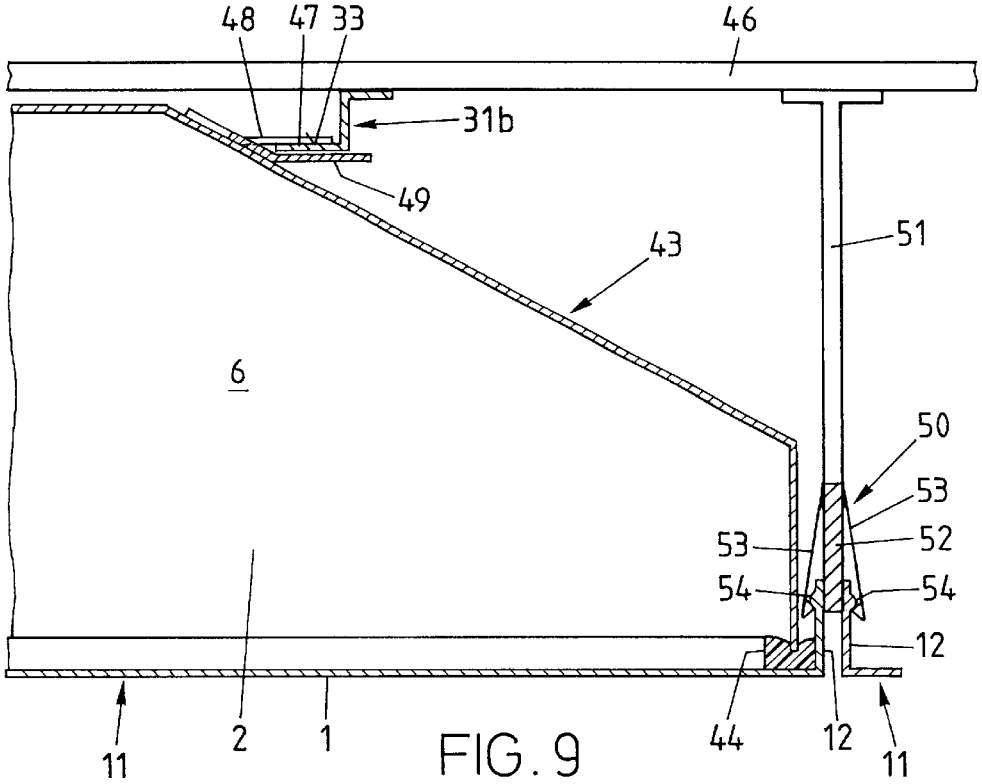
FIG. 9 shows a section through a part of the second embodiment of an air-cooling element in the air-cooling arrangement according to the invention and FIG. 10 shows a section through a connection between two successive air-cooling elements according to the second embodiment in the air-cooling arrangement according to the invention.

The air-cooling elements are suspended (FIG. 9) in a manner similar to that described in connection with the first embodiment. The air-cooling elements form air-cooling arrangements comprising rows arranged side by side, each row being pushed onto two rails 31*a,b* which are fastened to transverse beams 46 following one another at intervals in the longitudinal direction. The rails 31*a,b* have horizontal webs 47 which point towards one another, run continuously below the transverse beams 46 and a distance away therefrom and have upward-pointing support strips 33 which support short horizontal retaining plates 48 of the housing 43 which are fastened to the top wall 8 on both sides, in each case adjacent to the front plates 6, just outside the inner edges of the sections sloping obliquely downwards. Fastened in the middle on each of the two sides to the section sloping obliquely downwards, and located slightly lower than the retaining plates 48, is a stop plate 49 which is just below the underside of the web 47 and limits the mobility of the housing 43 in an upward direction so that its vertical position is fixed with a narrow tolerance.

The cooling wall 1 is held separately, independently of the housing 43. For this purpose, clamping rails 50 which are suspended by means of straps 51, likewise from the cross-beam 46, are arranged on both sides of the air-cooling element. The clamping rail 50 comprises in each case a sword 52 which is present between two adjacent rows of air-cooling elements in such a way that each of the two sides of said sword is abutted by the outside of the sidewall 12 of the trough 11. In each case one edge of the trough 11 is fixed by means of a spring strip 53 which grips by means of a bent-back lower end part in each case under retaining cams 54 on the inside of said sidewall 12 and presses the latter against the sword 52.

Figure 10:
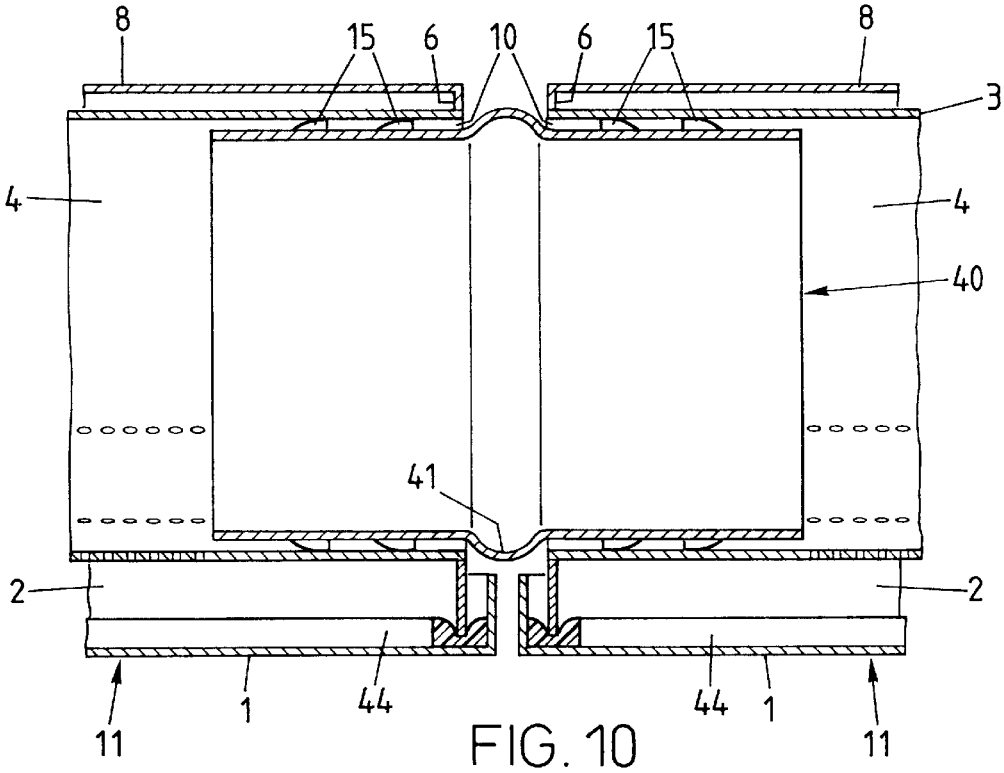

The connection between the antechambers 4 of two successive air-cooling elements of a row is produced (FIG. 10) in turn by a connecting nipple 40 whose external diameter is slightly smaller than the internal diameter of the connecting orifices 10 and of the antechambers 4. To facilitate its positioning, it has in the middle an all-round bead 41 located between the air-cooling elements 24*a,b*. On both sides of said beads, it is provided in each case with two sealing rings 15 which run all round the outside a distance apart, are in the form of lip seals and are present against the inside of the partition 3.

The housings 43 of the air-cooling elements can each be pushed in succession onto the rails 31*a,b*, a connecting nipple 40 being inserted into the rear connecting orifice 10 beforehand in each case, the projecting half of which connecting nipple passes into the front connecting orifice 10 of the housing subsequently pushed on, so that the connection is automatically produced. In the first housing of a row, a cover of similar design is pushed into the front connecting orifice 10 and closes it tightly. The last housing is connected to an air supply line by means of a funnel-like connecting fitting which is also similarly formed. Connecting nipples, covers and connecting fittings of this type are commercially available, for example from Lindab, Haynauer Strasse 48–52, D-12249 Berlin.

The associated trough 11 is then fastened underneath each housing 43 by pushing each of its sidewalls 12 between the sword 52 and the spring strip 53 until the latter grips below the retaining cam 54. The sealing strip 44 is thus clamped between the housing 43 and the cooling wall 1 and closes the chamber 2 air-tight—apart from the micro-holes in the cooling wall 1 and the air inlet 5.

LIST OF REFERENCE SYMBOLS

1 Cooling wall
2 Chamber
3 Partition
4 Antechamber
5 Air inlet
6 Front wall
7 Sidewall
8 Top wall
9 Recess
10 Connecting orifice
11 Trough
12 Sidewall
13 Slot
14 Screwbolt
15 Sealing ring
16 Retaining plate
17 Distributor nozzle
18 Cover
19 Fastening flange
20 Casing
21 Base
22 Passage
23 Air-cooling arrangement
24*a,b,c,d* Air-cooling elements
25 Bracket
26 Flange
27 Strip
28 Intermediate space
29 Lug
30 Recess
31*a,b* Rails
32 Screwbolt
33 Support strip
34 Retaining cam
35 Base
36 Support peg
37 Lug
38 Extension
39 Channel
40 Connecting nipple
41 Bead
42 Connecting piece
43 Housing
44 Sealing strip
45 *a,b,c,d,e* Rows of passages
46 Crossbeam
47 Web
48 retaining plate
49 stop plate
50 clamping rail
51 strap
52 sword
53 spring strip
54 retaining cam

What is claimed is:

1. An air-cooling element comprising:

a chamber having at least one air inlet and bounded on one side by a cooling wall, and wherein the cooling wall is made of a substantially impermeable material and includes a plurality of micro-holes distributed over its area so that its free cross-section is less than 2% of its area.

2. The air-cooling element according to claim 1, wherein the micro-holes are arranged in a regular grid.

3. The air-cooling element according to claim 1, wherein the micro-holes are round and each have a diameter of less than 0.8 mm.

4. The air-cooling element according to claim 1, wherein the cooling wall has a heat transfer coefficient of at least 40 $W/m^2K$.

5. The air-cooling element according to claim 4, wherein the cooling wall consists of sheet metal whose thickness is less than 1 mm.

6. The air-cooling element according to claim 5, wherein the sheet metal is made of a steel material.

7. The air-cooling element according to claim 1, wherein the chamber and the air inlet are designed in such a way that the heat transfer coefficient on the inside of the air-permeable wall, with the supply of a nominal air flow rate of at least 45 m/h, is at least 50 $W/m^2K$.

8. The air-cooling element according to claim 1, further comprising an antechamber having at least one air connection, and configured to be connected to the chamber by at least one air inlet.

9. The air-cooling element according to claim 8, wherein the at least one air inlet is configured to produce turbulence in an air flow from the antechamber into the chamber.

10. The air-cooling element according to claim 8, wherein the air inlet comprises a plurality of passages which open into the chamber.

11. The air-cooling element according to claim 10, wherein the passages each have a diameter of less than 1.5 mm.

12. The air-cooling element according to claim 10, wherein at least the majority of the passages are less than 10 cm away from the cooling wall.

13. The air-cooling element according to claim 8, wherein the antechamber is separated from the chamber by a partition.

14. The air-cooling element according to claim 13, wherein the air inlet comprises a plurality of passages which open into the chamber, and the passages are provided directly in the partition.

15. The air-cooling element according to claim 13, wherein the partition is shaped into at least one tubular section projecting through the chamber.

16. The air-cooling element according to claim 10, wherein the at least one air inlet comprises a distributor nozzle arranged to project into the chamber and in which the passages are arranged exclusively laterally, not directed towards the cooling wall.

17. The air-cooling element according to claim 8, further comprising laterally protruding retaining projections arranged on a side opposite the cooling wall so as to form downward-pointing stops.

18. An air-cooling arrangement comprising:

at least one row of air-cooling elements, each of the air-cooling elements including a chamber having at least one air inlet and bounded on one side by a cooling wall, the cooling wall of each air-cooling element being made of a substantially impermeable material and including a plurality of micro-holes distributed over its area so that a free cross-section of the cooling wall is less than 2% of its area, and an antechamber having at least one air connection and connected to the chamber by the at least one air inlet; and wherein the antechamber of an outermost air-cooling element is connected to an air supply line while the antechamber of each further air-cooling element is connected in each case with the antechamber of the preceding air-cooling element by an essentially air-tight connection.

19. The air-cooling arrangement according to claim 18, wherein the connection between two successive air-cooling elements is produced by a connecting piece projecting into connecting orifices of successive air-cooling elements, at least one sealing ring being clamped against the connecting piece in each case.

20. The air-cooling arrangement comprising at least one air-cooling element according to claim 18, further comprising at least one rail arrangement for displaceably suspending at least one part of each of the air-cooling elements.

21. The air-cooling arrangement according to claim 20, further comprising laterally protruding retaining projections arranged on a side opposite the cooling wall so as to form downwardly-pointing stops, and wherein the retaining projections rest on support strips of the rail arrangement.

22. The air-cooling arrangement according to claim 20, wherein the cooling wall of the at least one air-cooling element is separately suspended.

23. The air-cooling arrangement according to claim 22, wherein the rail arrangement comprises at least two clamping rails against each of which an angled edge strip adjacent to the cooling wall is clamped.

24. The air-cooling element according to claim 1, wherein the free cross-section of the cooling wall is less than 1% of its area.

25. The air-cooling element of claim 3, wherein each of the micro-holes has a diameter of less than 0.6 mm.

26. The air-cooling element of claim 7, wherein the chamber and the air inlet are configured such that the heat transfer coefficient on the inside of the air-permeable wall, when the supply of a nominal air flow rate is at least 45 m/h, is at least 80 $W/m^2K$.

27. A method for air-cooling comprising:

providing a chamber housing having an air inlet arranged to receive air and a cooling wall made of a substantially impermeable material; and dispensing air from the chamber housing and through less than 2% of the surface area of the cooling wall.

28. The method of claim 27, wherein the step of dispensing comprises allowing air to flow through less than 1% of the surface area of the cooling wall.

29. The method of claim 27, wherein the step of dispensing comprises the substep of providing a plurality of micro-holes on the cooling wall.

30. The method of claim 29, wherein the step of providing a plurality of micro-holes comprises the substep of arranging the micro-holes in a regular grid pattern.

31. The method of claim 29, wherein the micro-holes are round and have a diameter of less then 0.8 mm.

32. The method of claim 29, wherein the micro-holes are round and have a diameter of less than 0.6 mm.

33. The method of claim 27, wherein the step of providing a cooling wall comprises the step of configuring the cooling wall so as to have a heat transfer coefficient of 40 $W/m^2k$.

34. The method of claim 27, wherein the cooling wall comprises a metal sheet having a thickness of less than 1 mm.

35. The method of claim 27, further comprising the step of configuring the chamber and the air inlet such that a heat transfer coefficient on an inside of the cooling wall, when a nominal air flow rate of air flowing through the air inlet is at least 45 m/h, is at least 50 $W/m^2K$.

36. The method of claim 27, further comprising the steps of providing a substantially air-tight antechamber having at least one air connection, and connecting the antechamber to the chamber by the air inlet.

37. The method of claim 36, further comprising the step of configuring the air inlet so as to produce turbulence in an air flow from the antechamber into the chamber when a nominal air flow rate of air flowing through the air inlet is at least 45 m/h.

38. The method of claim 36, wherein the inlet comprises a plurality of passages opening into the chamber.

39. The method of claim 38, wherein each of the passages has a diameter of less than 1.5 mm.

40. The method of claim 38, wherein at least a majority of the passages are less than 10 cm away from the cooling wall.

41. The method of claim 36, further comprising the step of arranging a partition for separating the antechamber from the chamber.

42. The method of claim 41, wherein the air inlet comprises a plurality of passages opening into the chamber, and the passages are provided directly in the partition.

43. The method of claim 41, further comprising the step of shaping the partition into at least one tubular section projecting through the chamber.

44. The method of claim 38, wherein the air inlet comprises a distributor nozzle arranged to project into the chamber and in which the passages are arranged exclusively laterally so as not to be directed towards the cooling wall.

45. The method of claim 36, further comprising arranging at least one laterally protruding retaining projection on a side opposite the cooling wall so as to form at least one downward-pointing stop.

46. A method for air-cooling comprising:

providing a chamber having at least one air inlet and bounded on one side by a cooling wall made of a substantially impermeable material and having a plurality of micro-holes distributed over its area so that its free cross-section is less than 2% of its area; and dispensing air from the chamber and through the plurality of micro-holes of the cooling wall so as to provide a nominal air flow rate of at least 45 m/h, and generate a highly turbulent air flow and a heat transfer coefficient of at least 50 $W/m^2K$ on the inside of the cooling wall.

47. A method for air-cooling comprising:

providing a chamber having at least one air inlet and bounded on one side by a cooling wall made of a substantially impermeable material and having a plurality of micro-holes distributed over its area so that its free cross-section is less than 2% of its area;

providing a substantially air-tight antechamber connected to the chamber by an air inlet and having at least one air connection; and dispensing air from the antechamber into the chamber and through the plurality of micro-holes of the cooling wall such that a pressure drop between the antechamber and the chamber is at least three times a pressure drop across the cooling wall.

* * * * *